US005715802A

United States Patent [19]

Moore et al.

[11] Patent Number: 5,715,802

[45] Date of Patent: Feb. 10, 1998

[54] HEAD AND TORSO MOUNTABLE FOAM DART LAUNCHER

[75] Inventors: Michael A. Moore; Robert L. Brown, both of Cincinnati, Ohio

[73] Assignee: Hasbro, Inc., Pawtucket, R.I.

[21] Appl. No.: 705,112

[22] Filed: Aug. 29, 1996

[51] Int. Cl.[6] ..... F41B 11/14

[52] U.S. Cl. ..... 124/66; 124/84

[58] Field of Search ..... 124/56, 58, 59, 124/66, 67, 83, 84

[56] References Cited

U.S. PATENT DOCUMENTS

| | | | |
|---|---|---|---|
| 2,460,924 | 2/1949 | Dally | 124/62 |
| 2,654,973 | 10/1953 | Lemelson | 446/27 |
| 3,026,642 | 3/1962 | Ryan | 42/1.11 |
| 3,060,625 | 10/1962 | Glass et al. | 446/26 |
| 3,262,440 | 7/1966 | Kuhn | 124/67 |
| 3,271,033 | 9/1966 | Parker | 124/57 |
| 3,989,027 | 11/1976 | Kahelin | 124/58 |
| 4,016,854 | 4/1977 | Lehman | 124/27 |
| 4,159,705 | 7/1979 | Jacoby | 124/63 |
| 4,270,511 | 6/1981 | Ehama | 124/81 |
| 4,345,578 | 8/1982 | Speer | 124/56 |
| 4,644,930 | 2/1987 | Mainhardt | 124/58 |
| 5,303,847 | 4/1994 | Cottone | 222/78 |
| 5,370,278 | 12/1994 | Raynie | 222/175 |
| 5,377,656 | 1/1995 | Lewinski et al. | 124/65 |
| 5,592,931 | 1/1997 | Johnson et al. | 124/69 |

*Primary Examiner*—John A. Ricci

*Attorney, Agent, or Firm*—Marshall, O'Toole, Gerstein, Murray & Borun

[57] ABSTRACT

There is disclosed a projectile launcher with a firing mechanism that can be either hand-held or secured to a body plate. When secured to a body plate, the firing mechanism is attached to a conduit that has on its distal end, a secondary launch tube that can be hand-held or secured to head gear worn by the user and aimed with sights mounted on the head gear.

25 Claims, 7 Drawing Sheets

FIG. 3
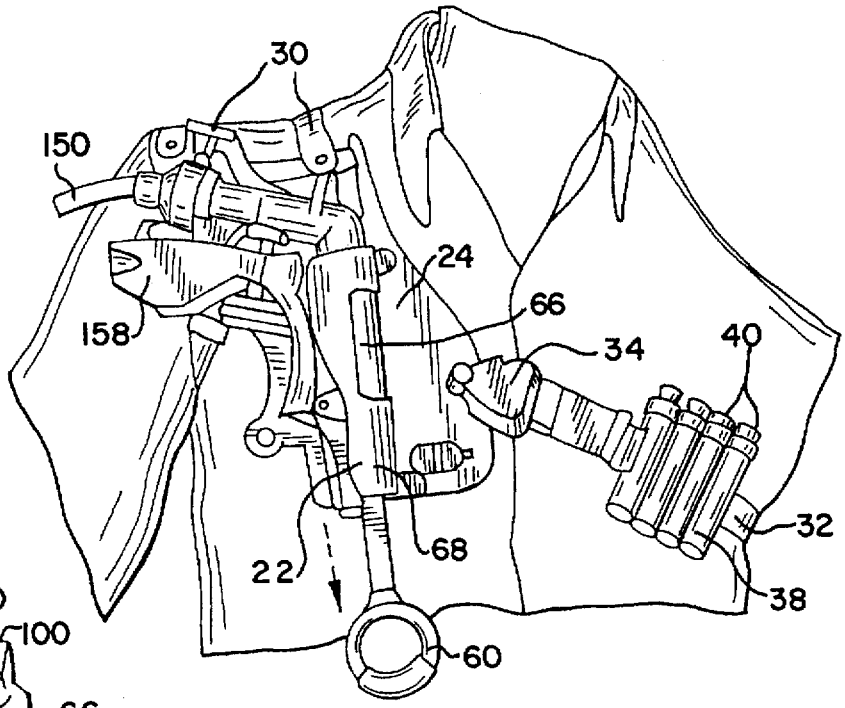
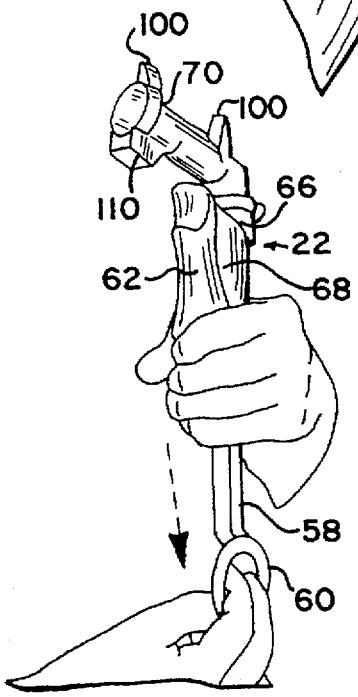
FIG. 4
FIG. 5
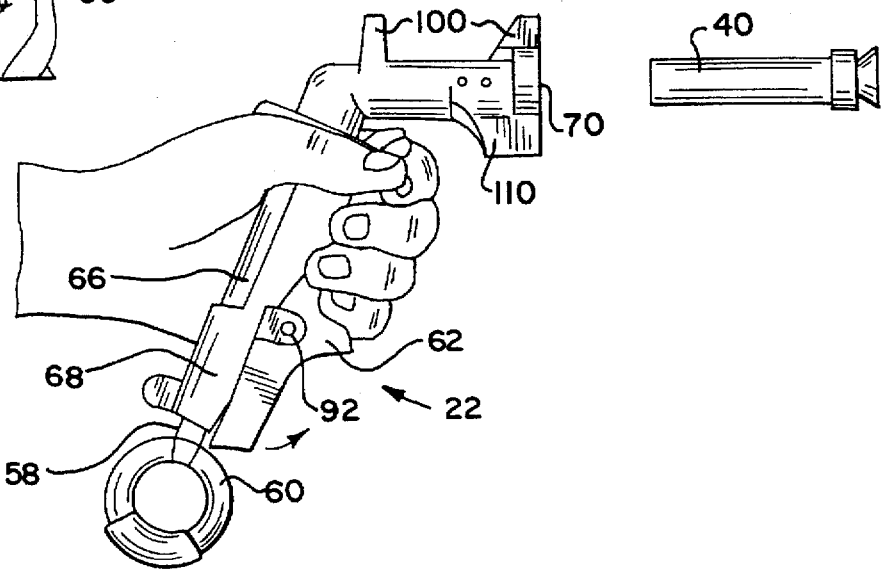

40
100
70
102
110
86
87
22
76
82
98
62
66
80
68
92
88
84
58
74
60
90

HEAD AND TORSO MOUNTABLE FOAM DART LAUNCHER

FIELD AND BACKGROUND OF THE INVENTION

This invention relates generally to toy projectile launchers and specifically to a toy projectile launcher having a firing mechanism adapted to be used as a hand-held gun or as a body-mounted mechanism that launches projectiles from a hand-held or head-mounted launch tube. The projectile launcher can further include a pivoting head-mounted apparatus that is aimed with a sight or a mirror to enhance the play value.

Toy projectile launchers having components that are body-mounted and head-mounted are known. For example, Raynie, U.S. Pat. No. 5,370,278 discloses a water toy having a body-mounted water tank, a hand-held trigger, and a head-mounted outlet that is aimed straight ahead using a sight that is positioned in front of a user's eye. There is no detachable mechanism that permits use of the water gun in hand-held modes or a trigger assembly that can be mounted on the water tank.

U.S. Pat. No. 5,303,847 discloses another type of water gun having a body-mounted tank and one or more remote dispensing nozzles that can be mounted on the user's fingertips, but no separate shooting mechanism can be detached and used alone in a separate play mode.

U.S. Pat. No. 2,654,973 discloses a toy cap having an action element thereon which is adapted to be powered by the breath of the wearer through an air tube.

Further, an aiming element for a toy projectile launcher is known which includes a mirror to enable the user to aim in a direction that is not in line with his or her eye such as in Kuhn, U.S. Pat. No. 3,262,440.

To enhance play value of a projectile launcher and provide numerous play options with a single toy, it is desirable to have a firing mechanism that can be used as a hand-held gun or mounted on a body plate with a flexible conduit joining the firing mechanism to a hand-held or head-mounted secondary launch tube. Further, the head-mounted tube can be fired forward using a see-through sight or in another direction using a mirror sight.

SUMMARY OF THE INVENTION

A projectile launcher in accordance with the present invention may comprise: a cylinder; a plunger slidably disposed in the cylinder between a cocked and an uncocked position; a trigger releasably engaging the plunger in the cocked position; a launcher tube in fluid communication with the cylinder and adapted to receive a projectile for launching; and a flexible conduit having an inlet in releasable engagement with the launcher tube and having a secondary launch tube adapted to receive a projectile for launching.

The projectile launcher may further include: a body plate pivotally engaged with the conduit and releasably joined to the cylinder; and a trigger release pivotally mounted on the body plate and having a camming surface for pivoting the trigger to disengage the plunger from the cocked position. The projectile launcher with a body plate also can include a lock operatively mounted on the body plate and in releasable engagement with the cylinder.

The projectile launcher may further include: head gear having a clip for mounting the secondary launch tube of the conduit and the head gear may have a sight mounted in substantial aiming alignment with the secondary launch tube or a mirror mounted on the head gear in substantial reflective aiming alignment with the secondary launch tube.

The projectile launcher also may include a housing fixed to the cylinder and having pivot pins on which the trigger is pivotally mounted.

Another embodiment of a projectile launcher in accordance with the present invention comprises: a cylinder; a plunger slidably disposed in the cylinder between a cocked and an uncocked position; a trigger pivotally mounted on the cylinder for releasably engaging the plunger in the cocked position; a launcher tube in communication with the cylinder; a body plate releasably engaged to the cylinder; a conduit releasably engaged with the launch tube; a secondary launch tube in fluid communication with the conduit; and a head gear defining a clip for releasably engaging the secondary launch tube.

The projectile launcher may include a trigger release pivotally mounted on the body plate for pivoting the trigger to release the plunger from the cocked position.

The head gear may include a sight and/or a mirror sight. The secondary launch tube can be mountable to the head gear in a plurality of directions.

The body plate may further include a locking mechanism for securing the cylinder to the body plate.

Yet another projectile launcher in accordance with the present invention may comprise: a cylinder; a plunger slidably disposed in the cylinder between a cocked and an uncocked position; a spring biasing the plunger toward the uncocked position; a trigger pivotally joined to the cylinder and releasably engaging the plunger in the cocked position; a launch tube in communication with the cylinder and adapted to receive a projectile to be launched; a body plate releasably joined to the cylinder; a trigger release pivotally joined to the body plate and having a camming surface to pivot the trigger and release the plunger from the cocked position; a conduit joined to the body plate, and having an inlet in releasable communication with the launch tube and a secondary launch tube adapted to receive a projectile to be launched; and head gear releasably joined to the secondary launch tube.

BRIEF DESCRIPTION OF DRAWINGS

FIG. 3 is a front view of the body plate-mounted firing mechanism in the cocked position;

FIG. 4 is a perspective view of a firing mechanism held in a user's hand while being cocked;

FIG. 5 is a side elevational view of the firing mechanism being fired in the hand-held mode;

DETAILED DESCRIPTION

Figure 1:
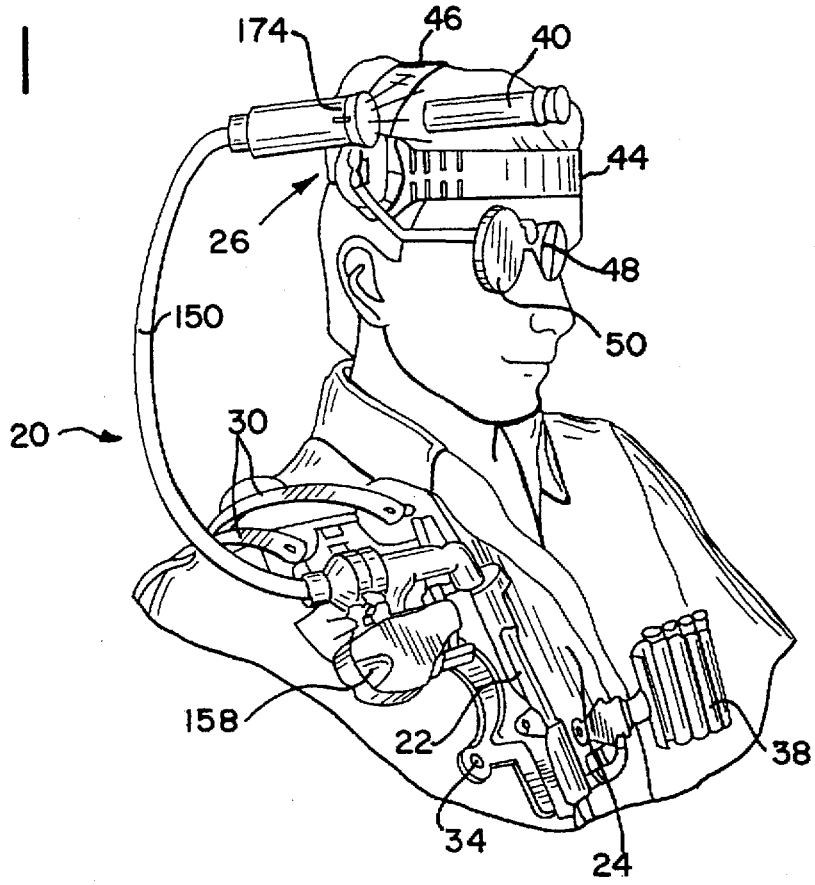
FIG. 1 is a perspective view of a toy projectile launcher in accordance with the present invention.
Figure 2:
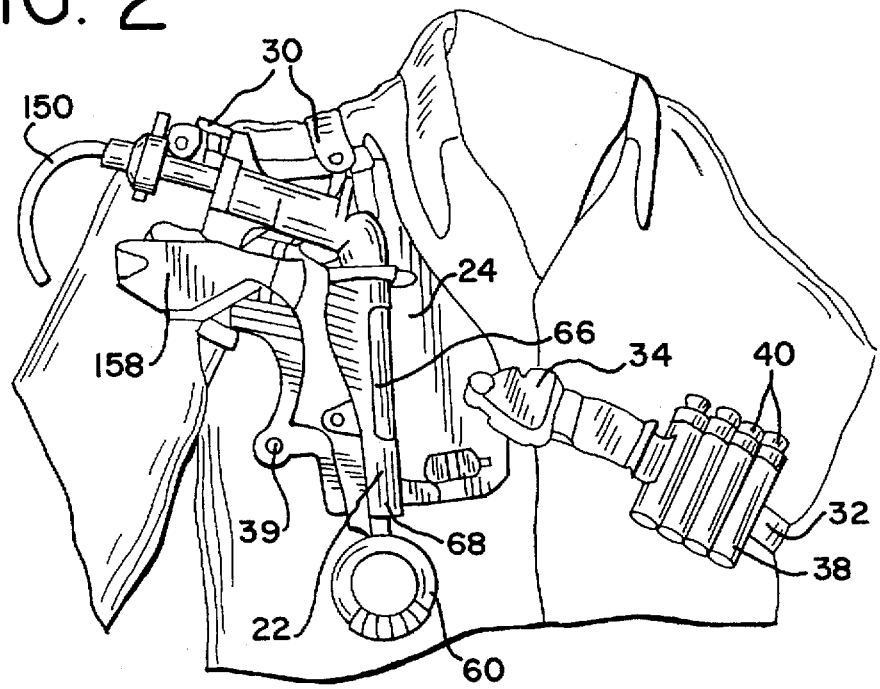
FIG. 2 is a front view of a firing mechanism in an uncocked position mounted on a body plate in accordance with the present invention.

To the extent practical, the same reference numerals will be used to identify the same elements in each of the figures. Illustrated generally in FIG. 1 is a toy projectile launcher 20 in accordance with the present invention which includes a firing mechanism 22, a body plate 24, and head gear 26. Most of the components are plastic to reduce weight and manufacturing costs. The firing mechanism 22 is mounted on the body plate 24 which in turn, is strapped to the torso of a user. The body plate 24 is contoured to generally fit a user near the right shoulder, but other shapes, including a flexible material, and other strapping locations can be used. The body plate 24 includes a pair of shoulder straps 30 and a torso strap 32 that are preferably made of a flexible material and can be adjusted in length to fit a number of different users comfortably. As illustrated in FIGS. 2 and 3 the torso strap 32 is joined to the contoured plate 28 using a hinged end piece 34 that allows torso strap 32 to pivot. Also included on the torso strap 32 is an ammunition holder 38 which can include any number of tubes in which projectiles may be stored such as the foam darts 40 illustrated in FIGS. 2 and 3. The shoulder straps 30 can be joined to a body plate hole 39 in a similar manner.

Referring to FIG. 1, the head gear 26 includes a horizontal strap 44 and a top strap 46 which combine to fix the head gear 26 to the user's head. The head gear 26 also includes a sight 48 with cross-hairs for aiming of a foam dart 40 and a mirror 50 which can be pivoted into alignment with the user's eye to aim a projectile in another direction.

In FIGS. 1, 2, and 3, the firing mechanism 22 is mounted on the body plate 24 to permit a user to have his or her hands free when not operating the projectile launcher 20. However, as illustrated in FIGS. 4 and 5, the firing mechanism 22 can be operated in a hand-held mode. FIG. 4 illustrates a user holding the firing mechanism 22 and pulling downward on a plunger 58 that includes a plunger ring 60 which is easily grasped and pulled. FIG. 5 illustrates the user squeezing a pivoting trigger 62 to release the plunger 58 from its cocked position and fire a foam dart 40. Details of the firing mechanism are illustrated in FIGS. 6 and 7.

Figures 6, 7:
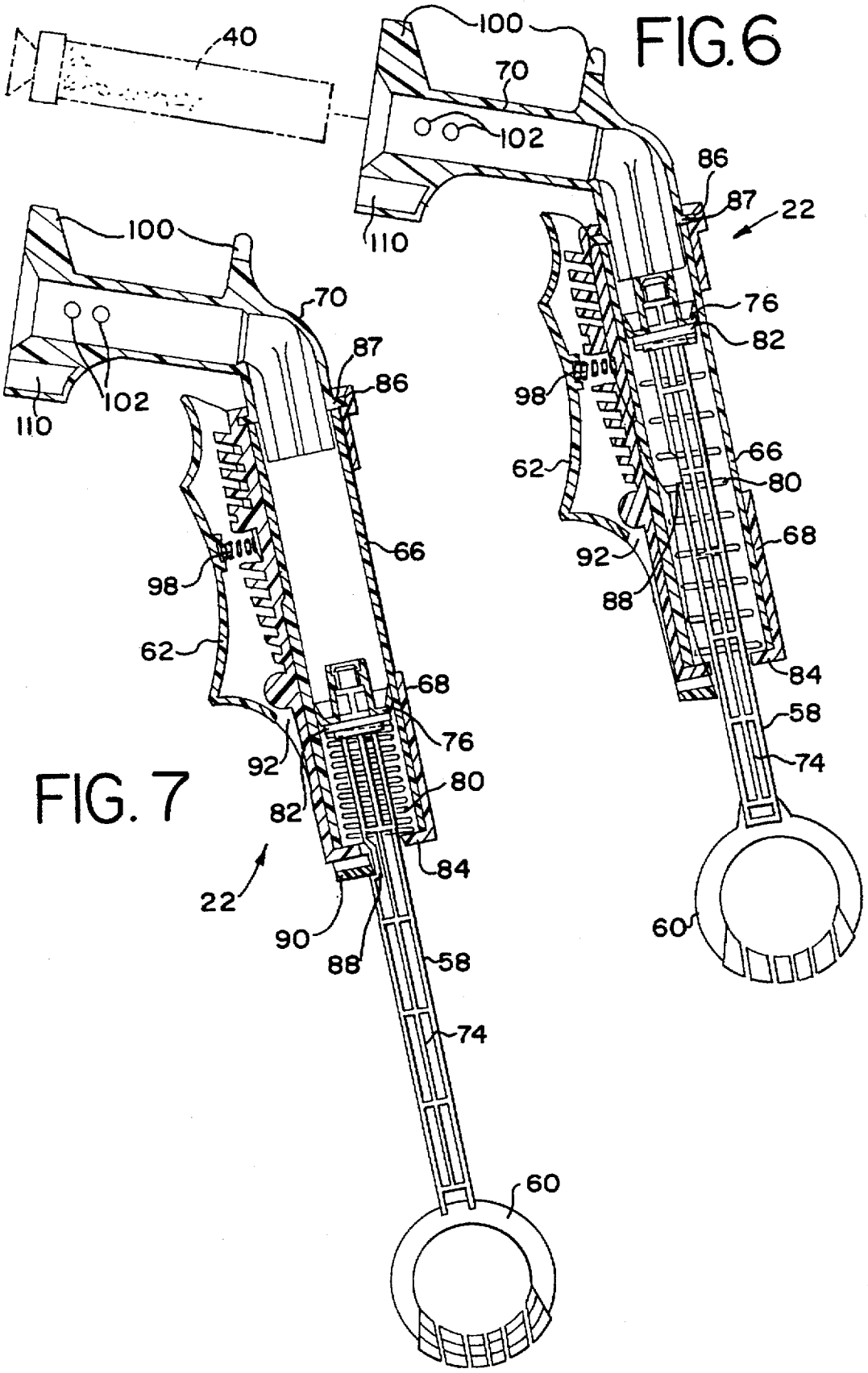
FIG. 6 is a cross-sectional view of the firing mechanism in the uncocked position.
FIG. 7 is a cross-sectional view of the firing mechanism in the cocked position.

As illustrated in FIGS. 6 and 7, the firing mechanism 22 includes a cylinder 66 which is generally round in cross-section and having a longitudinal axis. The cylinder 66 is preferably mounted in a housing 68, and includes at its top end a relatively ridged angled launch tube 70 and at the lower end of the cylinder 66 there is an opening through which the plunger 58 extends.

The plunger 58 includes a shaft 74, a pin-mounted seal 76 (preferably made of santoprene), and the plunger ring 60. The plunger is slidably disposed within the cylinder 66 between an uncocked position (FIG. 6) and a cocked position (FIG. 7). The plunger 58 is also disposed inside of a coil spring 80 (preferably made of steel) which is retained within the cylinder 66 between a plunger washer 82 and a flange 84 on the housing 68. In this manner, the coil spring 80 tends to bias the plunger 58 toward the uncocked position of FIG. 6. When desired to cock the plunger 58, the user grasps the plunger ring 60 and pulls downward until a ramped notch 88 is engaged by a sear 90 on the pivoting trigger 62.

The ramped notch 88 has a lower stepped portion that bears on the sear 90 against the bias of the coil spring 80. Should the user over-extend the plunger 58 while cocking, the sear 90 will ride up the ramped portion of the ramped notch 88 without being engaged by the sear 90 and the sear 90 will then ride back down into the notch 88 and engage the stepped portion as the plunger 58 is released.

Figures 8, 10:
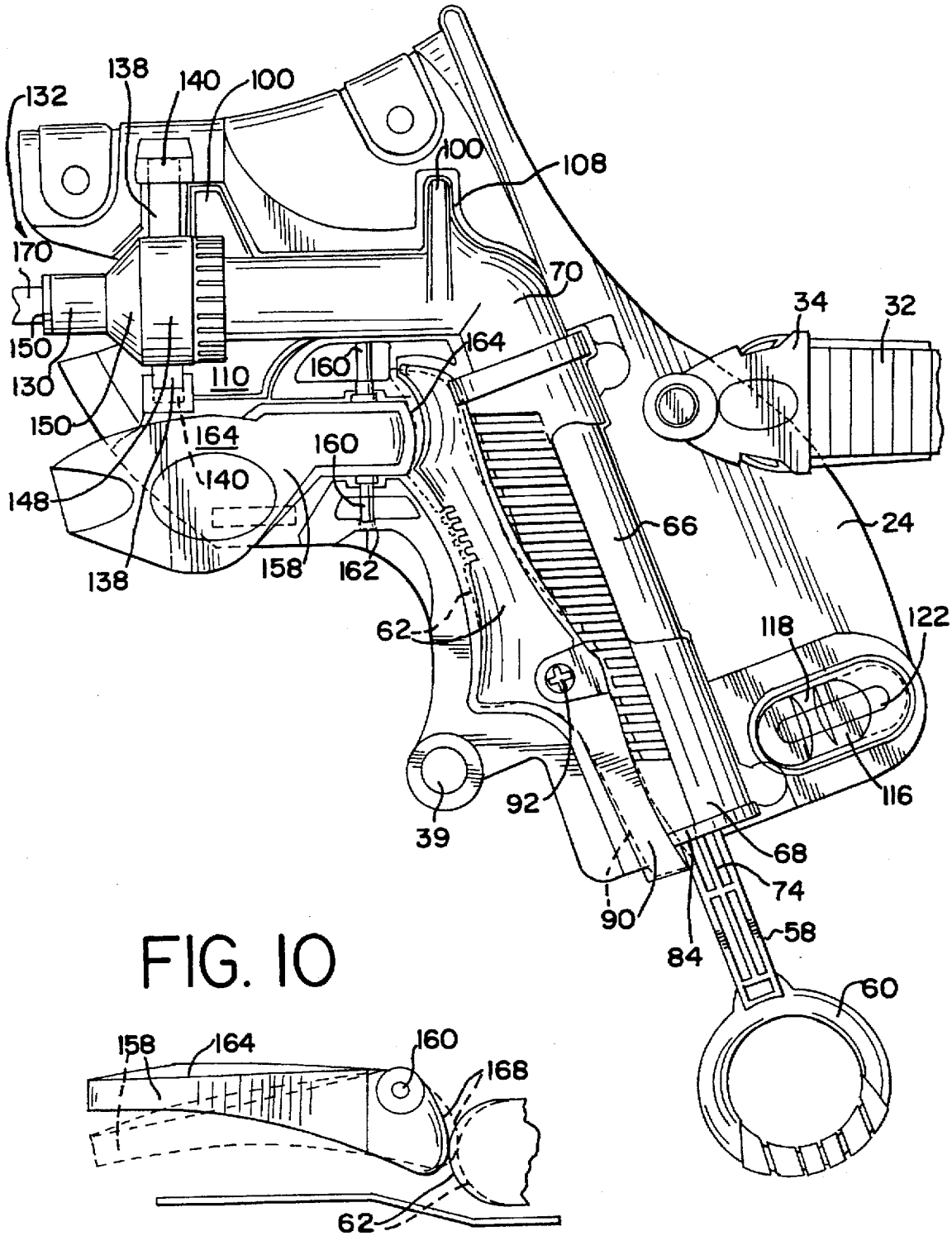
FIG. 8 is a front view body plate-mounted firing mechanism.
FIG. 10 is a trigger release mechanism mounted on the body plate for releasing a trigger on the firing mechanism from the cocked positioned.

The housing 68 is secured to the cylinder 66 by the lower flange 84 and an upper annular recess 86 that receives a mating annular ring 87 on the cylinder 66. The pivoting trigger 62 is joined to the housing 68 on a pair of housing pivot pins 94 (FIGS. 5 and 8). The pivoting trigger 62 has a portion above the pivot pins 94 that is contoured to be easily grasped and operated by a user. Below the pivot pins 94 there is a sear 90 which extends below the lower portion of the housing 68 and can engage the ramped notch 88 of the plunger 58. The trigger 62 is biased toward engagement with the ramped notch 88 by a trigger spring 98 (preferably made of steel) to ensure that the plunger 58 will remain in the cocked position when it is extended far enough out of the cylinder 66 so that the ramped notch 88 can be engaged by the sear 90. Preferably, the sear 90 includes an opening 92 through which the housing 68 can extend when the trigger 62 is pulled to maintain a compact design.

The launch tube 70 defines a bore sized to receive therein a foam dart 40, but other configurations and sizes may be used in accordance with this invention to accommodate other types and sizes of projectiles. Further, the launch tube 70 is preferably oriented at an angle relative to the longitudinal access of the cylinder 66 to be easier to aim by a user. Also preferably, the launch tube 70 is provided with a pair of alignment sights 100 to improve accuracy. It may be desirable to include a pair of ports 102 to attenuate some of the force of compressed air emanating from the cylinder 66 when the firing mechanism 22 is operated to maintain the velocity of the projectile 40 within safe limits. The ports 102 may also vent some air as the conduit (described below) is inserted into the launch tube 70.

Thus, the firing mechanism 22 can be operated as a hand-held blaster by grasping the housing 68 and the trigger 62 at a portion below the pivot pins 94 while pulling the plunger 66 downward until the ramped notch 88 is engaged by the sear 90 in the cocked position. When it is desired to launch a projectile 40 from the firing mechanism 22 the user simply moves his or her hand above the pivot pins 94 and squeezes the trigger 62 in a clockwise direction against the force of the trigger spring 98 to disengage the sear 90 from the ramped notch 88 to release the plunger 58 from the cocked position. When the plunger 58 is released from the cocked position, it will be urged upwardly by the force of the coil spring 80 whereby the seal 76 will compress air within the cylinder 66 and force compressed air into the launch tube 70 to launch the foam dart 40. When the trigger 62 is released the trigger spring 98 will urge the trigger 66 in a counter-clockwise direction where the sear 90 will then be available to engage the ramped notch 88 when the plunger 58 is recocked.

Figure 11:
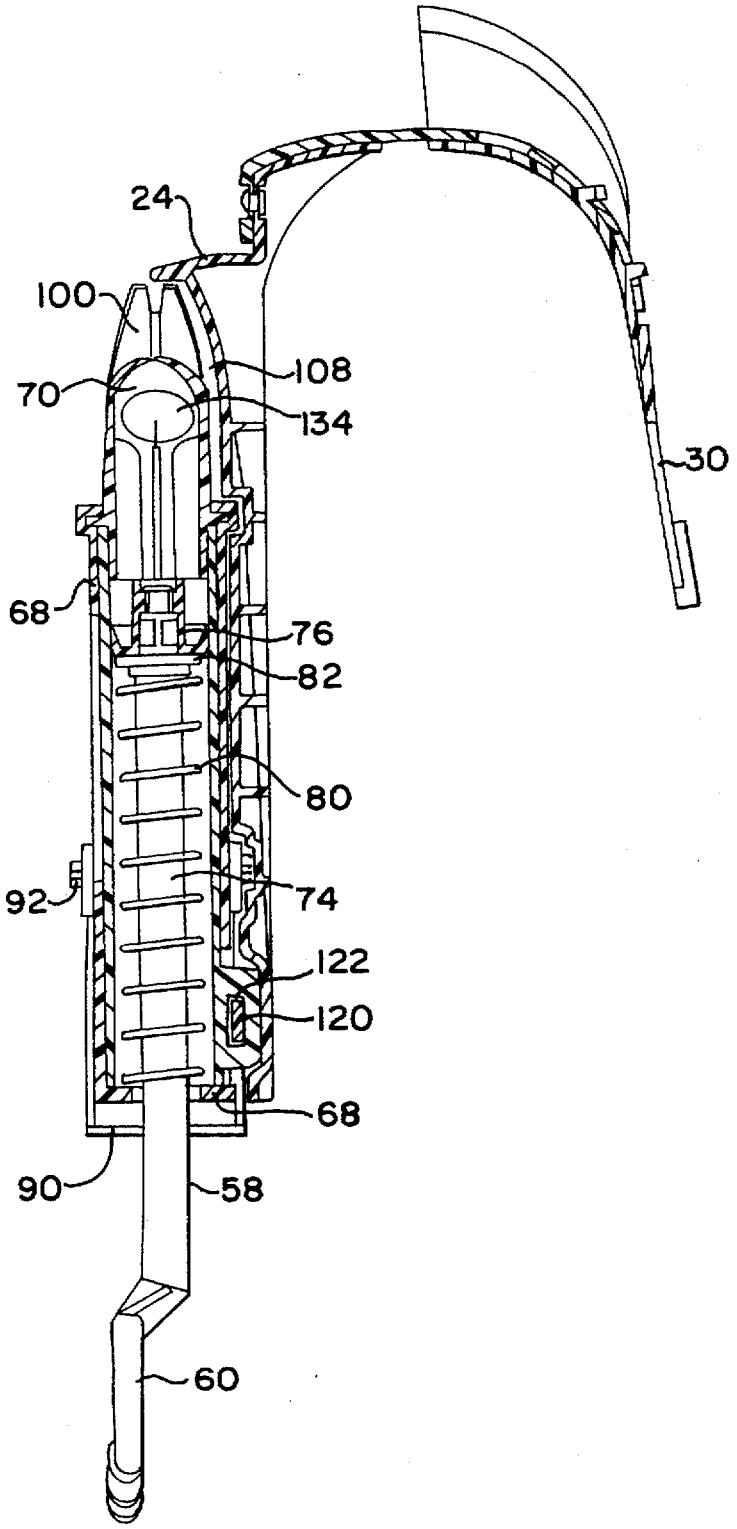
FIG. 11 is a side cross-sectional view of the firing mechanism in an uncocked position mounted in a recess defined by the body plate.

As best illustrated in FIG. 8, the firing mechanism 22 is mountable on the body plate 24 for an alternate mode of operation. The body plate 24 is provided with a recess 108 which receives the firing mechanism 22 to reduce bulk and provide smooth contours roughly following that of the user's body. To provide a snug fit between the firing mechanism 22 and the body plate 24 the recess 108 is further shaped to receive the alignment sights 100 and a lower launch tube tab 110. The trigger 62 also fits within a dedicated portion of the recess 108. Once in the recess 108, the firing mechanism 22 can be maintained therein using a lock 116 that includes a thumb latch 118 and a locking tab 120 (FIG. 11). The lock 116 is slidably received within a slot 122 in the body plate 24 and can be moved between an unlocked position and a locked position by moving the thumb latch 118 to engage the locking tab 120 within a recess 122 (FIG. 11) until it is desired to remove the firing mechanism 22 from the body plate 24 and reversing the operation of the lock 116. It is preferable to provide within the body plate 24 a pair of recesses into which a lock positioning flange (not illustrated) can be engaged in either the locked or the unlocked position for positive positioning of the lock 116.

Figures 9, 9A:
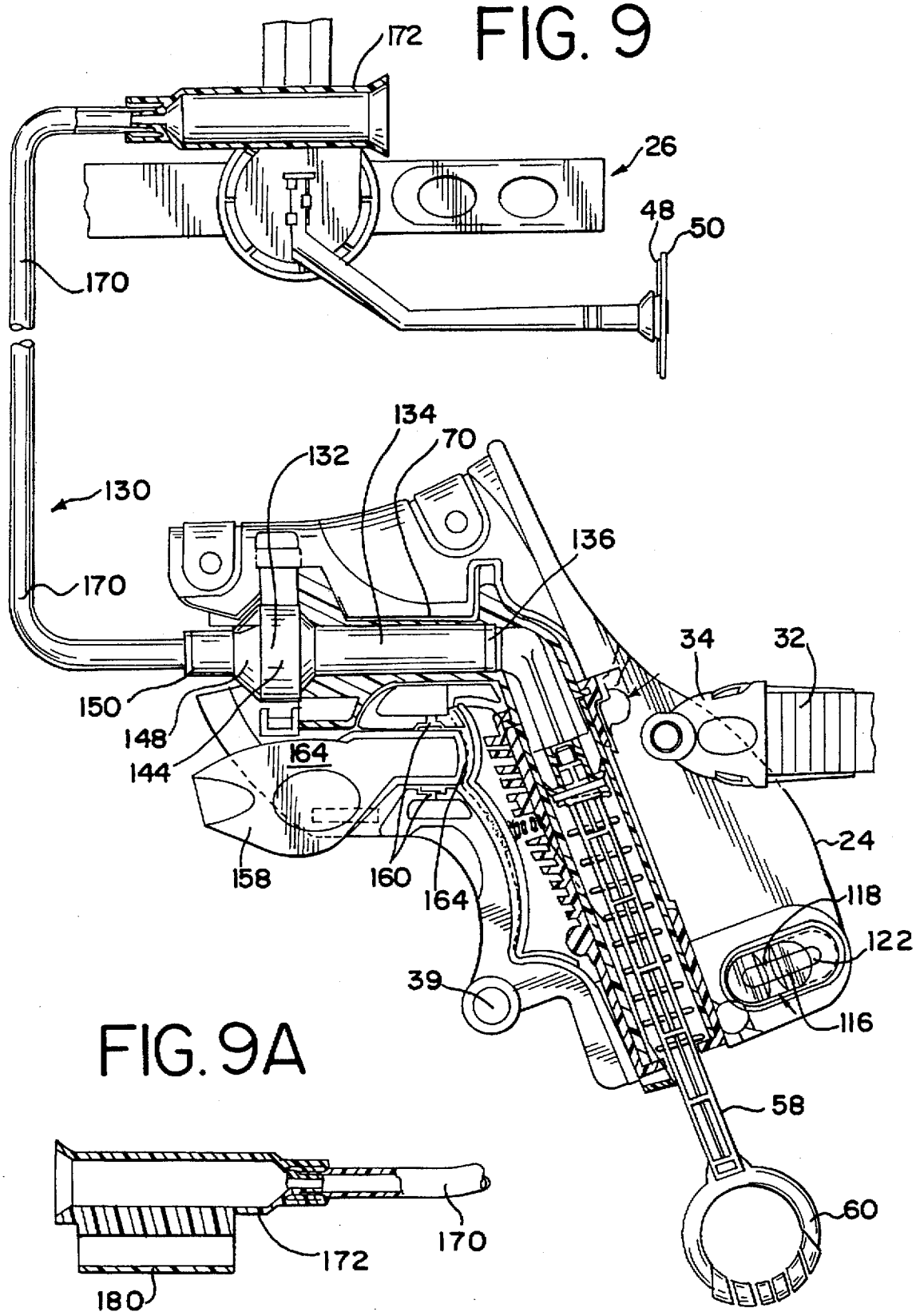
FIG. 9 is a front cross-sectional view of a body plate-mounted firing mechanism and a side view of a head gear with the conduit's secondary launch tube aligned with a sight.
FIG. 9A is a cross-sectional view of the secondary launch tube.

Also mounted on the body plate 24 is a trigger release mechanism 158 which is preferably pivotally joined to the body plate 24 at a location where it can interact with the firing mechanism trigger 62. The trigger release 158 includes a pair of laterally extending pins 160 preferably molded integrally therewith for engaging sockets 162 in the body plate 24. To the left of the pins 160 is a pressure portion 164 which can be engaged by the hand or arm of the user. To the right of the pins 160 is a camming surface 168 which will engage the firing mechanism trigger 62 as illustrated in FIGS. 8 to 10. When it is desired to pivot the trigger 62 to release the plunger 58 from the cocked position, the user simply pushes on the pressure portion 164 of the trigger release 158 to pivot the camming surface 168 which, in turn, pivots the trigger 62. The trigger release 158, need not be spring-loaded because the trigger spring 98 which biases the trigger 62 will also bias the trigger release 158. Thus, by applying pressure to the pressure portion 164 to engage the camming surface 168 with the trigger 62, the pressure of the trigger spring 98 will be overcome in the same manner as if the trigger 62 had been operated directly.

Also joined the body plate 24 is a conduit 130 (FIG. 9A) which is pivotally mounted to the body plate 24 using a relatively rigid inlet 132. The inlet 132 includes a stem 134 that can be positioned within the launch tube 70 to receive compressed air from the cylinder 66 when no foam dart 40 is positioned in the launch tube 70. To provide a satisfactory seal for efficient transfer of compressed gas from the cylinder 66 to the launch tube 70 a conduit seal 136 (preferably made of santoprene) is provided. Further, to improve the velocity of the compressed gas passing from the cylinder 66 to the conduit 130, the stem 134 is tapered internally to reduce the cross-sectional area of the inlet 132. The increased air velocity from the taper is desirable to overcome losses over the length of the conduit 130.

The inlet 132 is pivotally mounted to the body plate 24 with trunnions 138 extending laterally from the inlet 132. The trunnions pivot within sockets 140 molded integrally with the body plate 24. The inlet 132 is pivoted to the body plate 24 so that the relatively rigid inlet 132 can be inserted into the relatively rigid launch tube 70 and then pivoted to engage the firing mechanism into the recessed portion of the body plate 24 where it can be locked into place as described above. Alternatively, the launch tube 70 and/or the inlet 132 can be made of flexible material to enable the inlet 132 to be inserted into the launch tube 70 without pivoting the inlet 132 away from the body plate 24.

The inlet 132 is preferably formed in two pieces so that the stem 134 is molded integrally with a female portion 144 of the inlet 132 that in turn is molded integrally with the trunnions 138. Nested inside the female portion 144 is a male portion 148 that includes the tapered portion of the inlet and a nipple 150 for receiving the conduit 130. The male portion 148 and the female portion 146 may be glued or sonic welded together and may include any appropriate seals to enhance the transfer of compressed air through the conduit 130.

The conduit inlet 132 is joined to a flexible piece of PVC hose 170 that can be any desired length. At the downstream end of the conduit 130, there is positioned a secondary launch tube 172. The secondary launch tube 172 is adapted to receive a foam dart 40, but other types of projectiles may be used by altering the shape and configuration of the secondary launch tube 172, as desired. The secondary launch tube 172 can be hand-held to launch a projectile in any direction or it can be releasably mounted onto the head gear 26.

Molded integrally with the secondary launch tube 172 is a mounting tube 180 (FIG. 9A) which can be snapped in either of two orientations directed 180° apart on the head gear to fire forward or backward from either side of a user's head. When used in the hand-held mode, the secondary launch tube 172 can be held by the mounting tube 180 and aimed by looking down an integrally molded sight 174. Preferably, the mounting tube 180 is sized to fit into spare dart holders on other projectile launchers of a similar variety. In this manner, the secondary launch tube 172 can be mounted on and fired from other projectile launchers (not illustrated).

Figure 12:
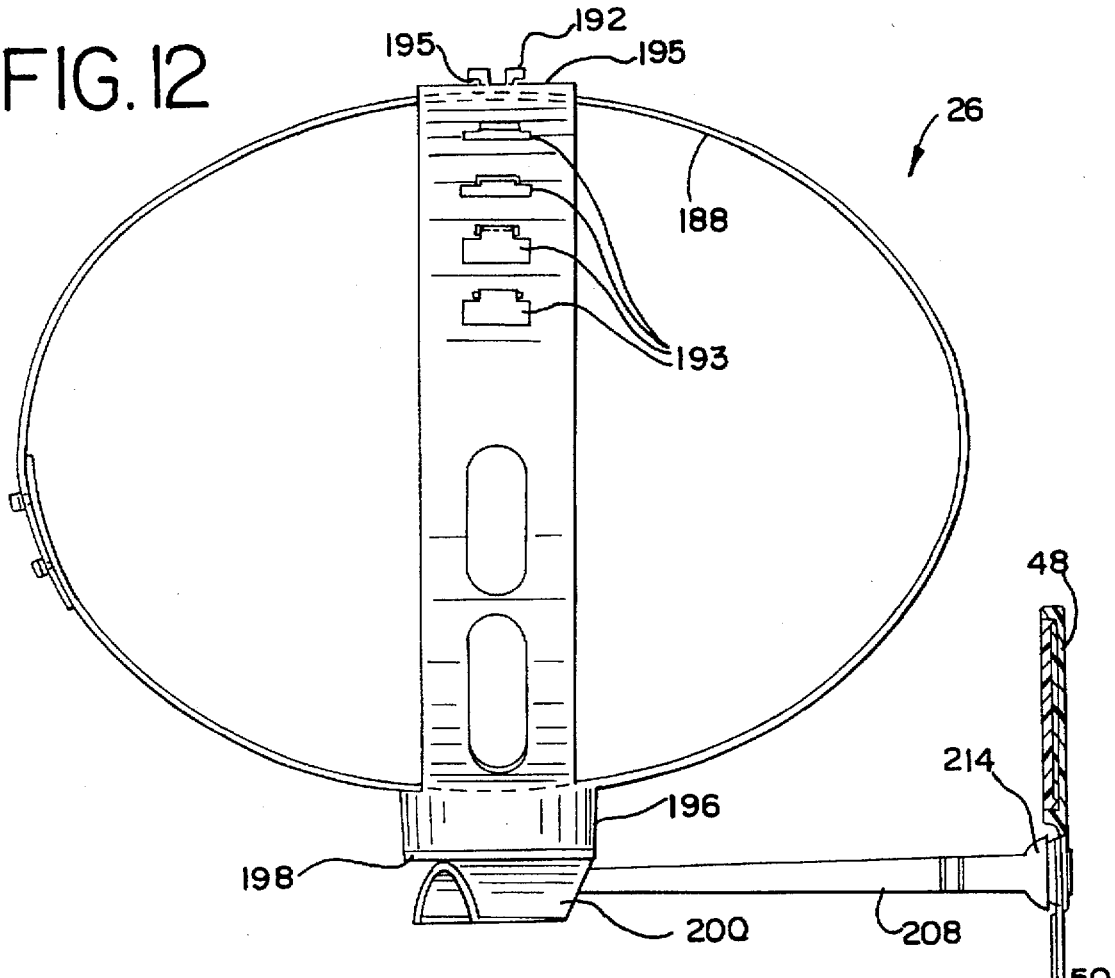
FIG. 12 is a top view of a head gear with a sight and mirror sight.
Figure 13:
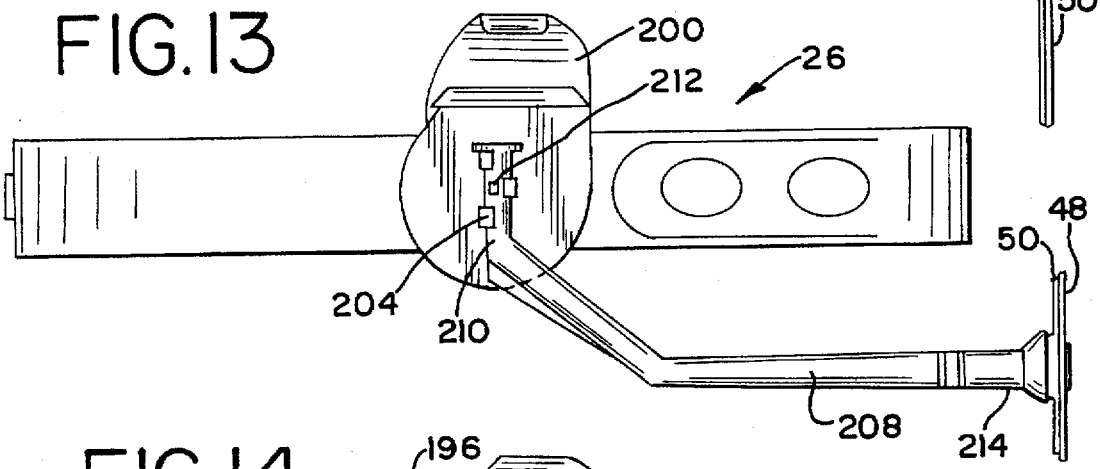
FIG. 13 is a side elevational view of a head gear and sighting mechanism.
Figure 14:
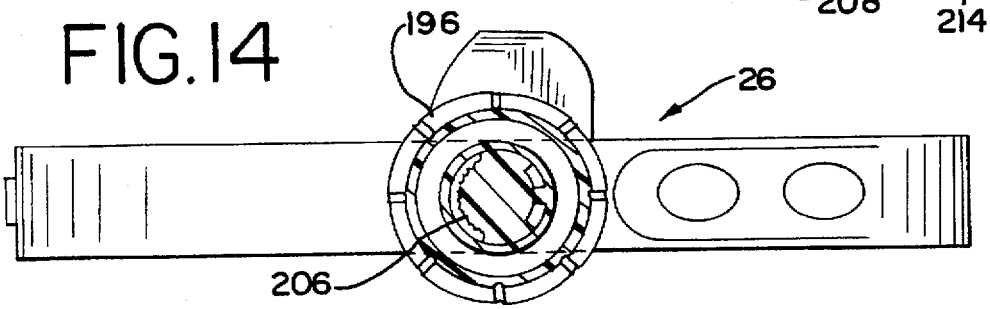
FIG. 14 is a side elevational view of a notched portion of a pivoting disk that prevents inadvertent movement of a secondary launch tube and the sights.

As best illustrated in FIGS. 12, 13, and 14, the head gear 26 includes a horizontal strap 188 and a top strap 190 that are both preferably flexible and adjustable to fit a variety of user head sizes comfortably. These straps and those on the body plate 24 are adjustable by using a series of U-shaped tabs 192 (FIG. 12) at one end of a strap to engage openings 193 in the other end of the strap. The openings 193 provide two different cross-sectional areas, one which is large enough to accommodate the U-shaped flanges and another that slidably receives the U-shaped flanges and prevents their being easily pulled out of the openings. Small raised tabs 195 may be added to provide additional resistance to disengagement.

On one side of the horizontal strap 188 there is provided a hub 196 for engaging a pivoting disk 198 that permits the head gear components to be worn on either the left side or the right side. The pivoting disk 198 includes a C-shaped head clip 200 into which the secondary launch tube's mounting tube 180 can be snapped or slid.

Beneath the tube clip 200, there is an eye piece support clip 204 that is illustrated as including three prongs. The pivoting disk 198 is preferably molded integrally with the tube clip 200 and the eye piece support clip 204 and is pivotally mounted to the hub 196 with an integrally molded pin that is snapped into a round opening in the hub 196. The head clip can pivot to provide a variety of launch orientations for the secondary launch tube 172. It is preferable to provide the pivoting disk 198 with a series of detents 206 (FIG. 14) that engage a tab (not illustrated) on the head gear 26 to provide positive stops for the disk 198 so that the disk 198 will not move when the user's head moves.

An eye piece support arm 208 includes a proximate end 210 that snaps into the eye piece support clip 204. Optional tabs 212 can be molded integrally onto the support arm proximate end 210 to provide positive engagement with the eye piece support clip 204 in a number of positions. Preferably, the eye piece support arm 208 is shaped as illustrated, but other shapes can be used to bring the sight 48 and mirror sight 50 into alignment with the user's eye. Mounted on the distal end 214 of the eye piece support arm 208 are the sight 48 and mirror sight 50. The sight 48 and mirror sight 50 are preferably pivotally mounted to the support arm 208 so that they can be easily moved in and out of alignment with the user's eye as needed. To enable this pivoting movement, it is preferable that the distal end 214 of the support arm 208 include a funnel shaped recess into which a matching dish-shaped protrusion on mirror sight 50 can fit. A funnel-shaped portion of the sight 48 can extend through the dish-shaped protrusion and into the support arm 208 to maintain alignment with the eye piece support arm 208. The three components can be joined together with a self-tapping screw or other appropriate means.

Thus, as can be seen from the above-referenced description, a user can operate the firing mechanism 22 in a hand-held mode by simply grasping the housing 68 and the trigger 62 below the trigger pins 94 while pulling downward on the plunger ring 60 to put the plunger 58 in a cocked position. When it is desired to fire a foam dart 40 from the launch tube 70, the foam dart 40 is simply inserted into the launch tube 70 and the trigger 62 is squeezed above the pivot pins 94 to disengage the sear 90 from the plunger's ramped notch 88 and release the plunger 58 from the cocked position. The plunger seal 76 will then compress air within the cylinder 66 to fire the foam dart 40 from the launch tube 70.

In a second operating mode, the user detachably secures the firing mechanism 22 to the body plate 24 by inserting the conduit inlet 132 into the launch tube 70 and pivoting the two so that the firing mechanism 22 is positioned within the body plate recess 108. The lock 116 can be activated to releasably secure the firing mechanism 22 in place. At this point, the user can simply grasp the secondary launch tube 172 by the mounting tube 180 to aim the foam dart 40 in any desired direction. By grasping the plunger ring 60 and pulling down, the plunger 58 can be put into the cocked position until it is desired to launch the foam dart 40. At such time, the trigger release 148 can be pushed toward the body plate 24 so that the camming surface 168 pivots the trigger 62 to release the plunger 58 from the cocked position. As the plunger 58 moves upward, it compresses gas within the cylinder 66 and releases the compressed gas through the conduit inlet 132, through the flexible hose 170, and out the secondary launch tube 172 to launch a foam dart 40.

In a third operating mode, the secondary launch tube's mounting tube 180 is secured to the tube clip 200 on the head gear 26. The orientation of the secondary launch tube 180 can be adjusted by pivoting the disk 196 or by installing the mounting tube 180 in either of the two possible orientations into the tube clip 200. Depending upon the orientation of the secondary launch tube 172, the user can either position the sight 48 in front of his or her eye to bring the launch tube 172 into substantial aiming alignment with the sight 48 or he or she can position the sighting mirror 50 to reflectively sight align the secondary launch tube 172 with the user's vision in the sight mirror 50. The firing mechanism 22 is then operated as described above to launch a foam dart 40 from the head gear 26.

The foregoing detailed description is provided for clearness of understanding only, and no unnecessary limitations therefrom should be read into the following claims.

We claim:

1. A projectile launcher comprising:

a cylinder;

a plunger slidably disposed in the cylinder for movement from a cocked position to an uncocked position to compress gas in the cylinder;

a trigger releasably engaging the plunger in the cocked position;

a launcher tube to receive compressed gas from the cylinder and adapted to receive a projectile for launching; and a flexible conduit to receive compressed gas from the launcher tube, and having an inlet in releasable engagement with the launcher tube and a secondary launch tube adapted to receive a projectile for launching.

2. The projectile launcher of claim 1 and further comprising:

a body plate pivotally engaged with the conduit and defining a recess into which the cylinder is releasably disposed; and a trigger release pivotally mounted on the body plate and having a camming surface for pivoting the trigger to disengage the plunger from the cocked position.

3. The projectile launcher of claim 2 and further comprising:

a lock operatively mounted on the body plate and in releasable engagement with the cylinder.

4. The projectile launcher of claim 1 and further comprising:

head gear having a clip for releasably mounting the secondary launch tube.

5. The projectile launcher of claim 4 and further comprising:

a sight mounted on the head gear in substantial aiming alignment with the secondary launch tube.

6. The projectile launcher of claim 4 and further comprising:

a mirror mounted on the head gear in substantial reflective aiming alignment with the secondary launch tube.

7. The projectile launcher of claim 1 in which the secondary launch tube defines a bore for receiving a projectile to be launched.

8. The projectile launcher of claim 1 and further comprising:

a housing fixed to the cylinder; and pivot pins joined to the housing and in pivoting engagement with the trigger.

9. A projectile launcher, comprising:

a cylinder;

a plunger slidably disposed in the cylinder for movement from a cocked position to an uncocked position to compress gas in the cylinder;

a trigger pivotally joined to the cylinder, for releasably engaging the plunger in the cocked position;

a launch tube to receive compressed gas from the cylinder;

a body plate releasably engaged to the cylinder;

a conduit to receive compressed gas from the launch tube, and releasably engaged to the launch tube;

a secondary launch tube to receive compressed gas from the conduit; and head gear defining a clip releasably engaged to the secondary launch tube.

10. The projectile launcher of claim 9 and further comprising:

a trigger release pivotally mounted on the body plate to pivot the trigger and release the plunger from the cocked position.

11. The projectile launcher of claim 9 and further comprising:

a sight joined to the head gear in substantial aiming alignment with the secondary launch tube.

12. The projectile launcher of claim 9 and further comprising:

a front viewing sight joined to the head gear; and a rear viewing sight joined to the head gear.

13. The projectile launcher of claim 12 in which the rear viewing sight comprises a mirror.

14. The projectile launcher of claim 9 in which the launch tube defines a bore adapted to receive therein a conduit inlet.

15. The projectile launcher of claim 9 in which the body plate further comprises a locking mechanism for releasably securing the cylinder to the body plate.

16. The projectile launcher of claim 9 and further comprising:

a spring for biasing the plunger toward the uncocked position.

17. The projectile launcher of claim 9 in which the secondary launch tube is mountable to the head gear in a plurality of orientations.

18. The projectile launcher of claim 9 in which the conduit comprises:

an inlet defining a bore of decreasing cross-sectional area.

19. The projectile launcher of claim 9 and further comprising:

a housing joined to the cylinder; and pins joined to the housing and in pivoting engagement with the trigger.

20. The projectile launcher of claim 9 in which the plunger comprises a notch and the trigger comprises a sear in releasable engagement with the notch when the plunger is in the cocked position.

21. A projectile launcher comprising:

a cylinder;

a plunger slidably disposed in the cylinder for movement from a cocked position to an uncocked position to compress gas in the cylinder;

a spring biasing the plunger toward the uncocked position;

a trigger pivotally joined to the cylinder and releasably engaging the plunger in the cocked position;

a launch tube to receive compressed gas from the cylinder and adapted to receive a projectile to be launched;

a body plate releasably joined to the cylinder;

a trigger release pivotally jointed to the body plate and having a camming surface to pivot the trigger and release the plunger from the cocked position;

a conduit joined to the body plate, and having an inlet to receive compressed gas from the launch tube and in releasable communication with the launch tube, and a secondary launch tube adapted to receive a projectile to be launched; and head gear releasably joined to the secondary launch tube.

22. The projectile launcher of claim 21 and further comprising:

a lock operatively joined to the body plate to releasably secure the cylinder to the body plate.

23. The projectile launcher of claim 21 and further comprising:

a sight joined to the head gear in substantial aiming alignment with the secondary launch tube.

24. The projectile launcher of claim 21 and further comprising:

a mirror joined to the head gear in substantial reflective aiming alignment with the secondary launch tube.

25. The projectile launcher of claim 21 in which the secondary launch tube defining a bore for receiving a projectile to be launched.

* * * * *